US005921905A

United States Patent [19]

Newman, Jr. et al.

[11] Patent Number: 5,921,905

[45] Date of Patent: Jul. 13, 1999

[54] ADJUSTABLE ROLLER HOLDER WITH RACK AND PINION GEAR MECHANISM

[75] Inventors: Robert D. Newman, Jr.; Robert D. Newman, Sr., both of P.O. Box 377, Greenwood, Mo. 64034; Buford Guittar, Greenwood, Mo.

[73] Assignees: Robert D. Newman, Sr.; Robert D. Newman, Jr., both of Greenwood, Mo.

[21] Appl. No.: 08/734,257

[22] Filed: Oct. 21, 1996

[51] Int. Cl.[6] ..... B44D 3/28

[52] U.S. Cl. ..... 492/13; 492/19

[58] Field of Search ..... 492/13, 15, 14, 492/19; 15/230.11

[56] References Cited

U.S. PATENT DOCUMENTS

| | | | |
|---|---|---|---|
| 2,970,366 | 2/1961 | Gill | 15/230.11 |
| 3,593,361 | 7/1971 | Welt | 15/230.11 |
| 3,604,046 | 9/1971 | Taylor | 15/230.11 |
| 3,745,624 | 7/1973 | Newman | 492/13 |

*Primary Examiner*—Irene Cuda

*Attorney, Agent, or Firm*—Hovey, Williams, Timmons & Collins

[57] ABSTRACT

An adjustable roller holder (10) that can be selectively adjusted to hold rollers of various lengths is disclosed. The adjustable roller holder includes a pair of spaced-apart roller-engaging arm assemblies (14) configured for holding a roller therebetween and a rack (58) and pinion-type (60) adjusting mechanism for selectively adjusting the distance between the arm assemblies for permitting the roller holder to hold rollers of different lengths.

13 Claims, 2 Drawing Sheets

ADJUSTABLE ROLLER HOLDER WITH RACK AND PINION GEAR MECHANISM

BACKGROUND OF THE INVENTION

1. Field of the Invention

The present invention relates to roller holders for holding paint and other types of rollers, and more particularly to an adjustable roller holder that can be selectively adjusted to hold rollers of various lengths.

2. Description of the Prior Art

Paint rollers are manufactured in several different lengths typically ranging from approximately 7" to 12". Unfortunately, known roller holders are configured for holding only one length of roller. Thus, painters who wish to use rollers of more than one length must currently purchase and use a separate roller holder for each length of roller used. This raises the equipment costs and equipment storage requirements for painters.

OBJECTS AND SUMMARY OF THE INVENTION

In view of the above-described limitations of prior art roller holders, it is an object of the present invention to provide an adjustable roller holder that can hold rollers of more than one length.

It is a more particular object of the present invention to provide an adjustable roller holder that can be selectively retracted and extended to any position for holding rollers of any length.

It is another object of the present invention to provide such an adjustable roller holder that is inexpensive to manufacture and easy to use.

The present invention achieves these and other objects that become evident from the following description of a preferred embodiment of the invention by providing an adjustable roller holder that can be selectively adjusted for holding rollers of any length. The preferred adjustable roller holder broadly includes a pair of spaced-apart roller-engaging arm assemblies configured for holding a roller therebetween and adjusting means for selectively adjusting the distance between the arm assemblies.

The preferred adjusting means is a rack and pinion-type gear mechanism including a pair of rack-type gears each formed in or attached to one of the roller-engaging arm assemblies and a rotatable, pinion-type adjustment knob that is operably coupled with the rack-type gears and rotatably coupled to the roller holder. When the adjustment knob is rotated, it moves the rack gears for selectively adjusting the distance between the roller-engaging arm assemblies.

In preferred forms, the adjusting means allows the arm assemblies to be selectively moved to any position between a fully retracted position for holding a standard 7" roller therebetween and a fully extended position for holding a full-size 12" roller therebetween. However, those skilled in the art will appreciate that the adjusting means may be adapted so that the roller blade may be adjusted to hold any length of roller.

By constructing an adjustable roller holder as described herein, numerous advantages are realized. For example, by providing the roller holder with adjusting means for selectively adjusting the distance between the roller-engaging arm assemblies, a single roller holder can be used to hold rollers of any length. Thus, painters may purchase and use a single roller holder for all of their rollers regardless of the rollers' lengths.

Additionally, by constructing the adjusting means with a rack and pinion-type gear mechanism, the distance between the roller-engaging arm assemblies can be discretely adjusted to a multitude of positions rather than just a few different positions. Moreover, the rack and pinion-type gear adjusting mechanism is inexpensive to manufacture and easy to use.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENTS

Figure 1:
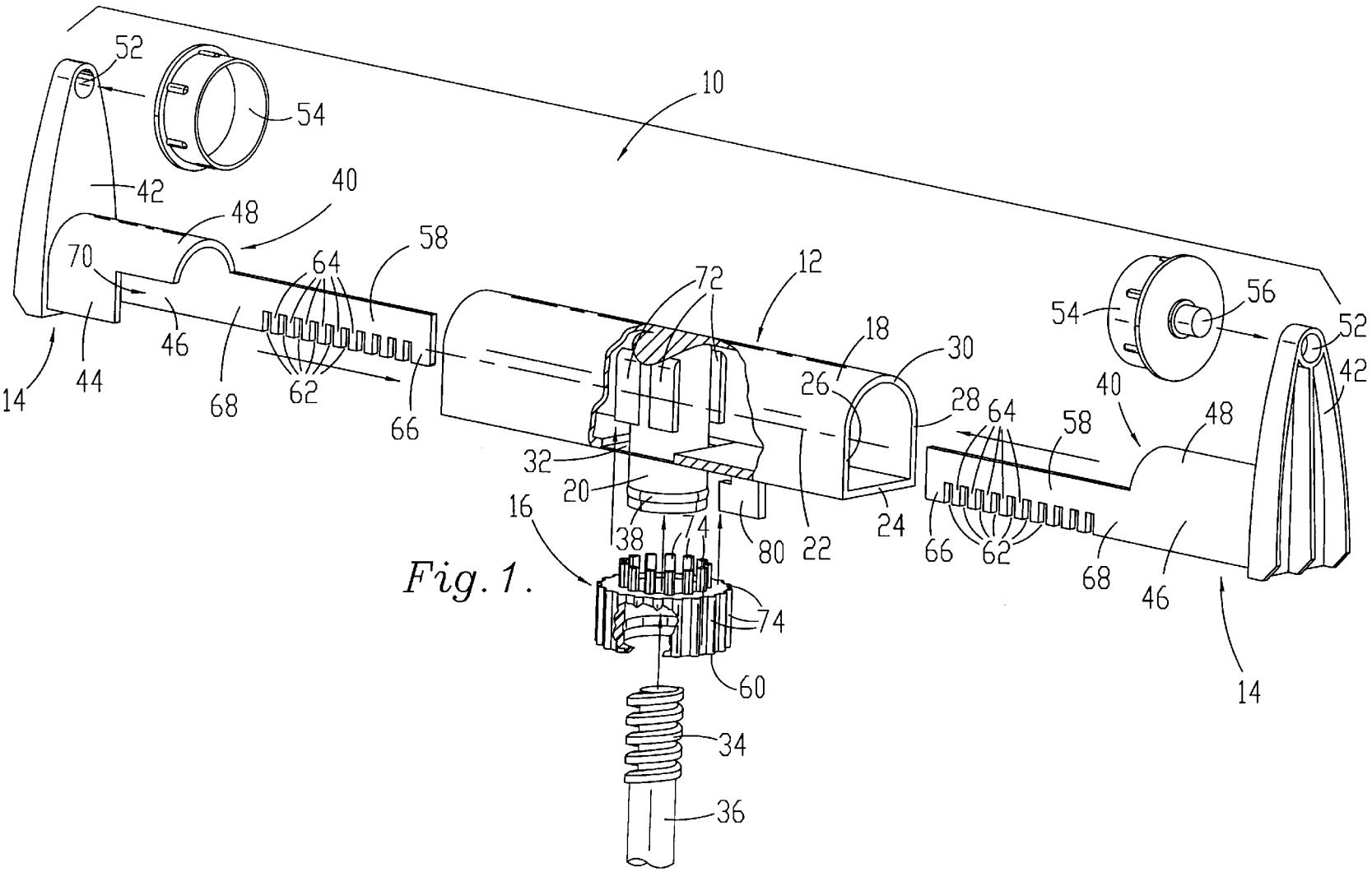
FIG. 1 is an exploded perspective view of an adjustable roller holder constructed in accordance with a preferred embodiment of the invention.

Turning now to the drawing figures, and particularly FIG. 1, an adjustable roller holder 10 constructed in accordance with a preferred embodiment of the invention is illustrated. The adjustable roller holder 10 is configured for holding paint and other types of rollers and is preferably formed from molded synthetic resin materials or other suitable materials.

The roller holder broadly includes a central body portion 12, a pair of spaced-apart, roller-engaging arm assemblies 14 telescopically mounted relative to the body portion 12, and adjusting means broadly referred to by the numeral 16 for selectively positioning the arm assemblies relative to the body portion for adjusting the distance between the arm assemblies for permitting the roller holder to hold rollers of various lengths.

In more detail, the central body portion 12 includes an elongated hollow sleeve 18 and a mounting post 20. The sleeve 18 has a longitudinal axis 22 depicted in FIG. 1 and is generally D-shaped in cross section. The sleeve 22 includes a generally planar base wall 24, a pair of spaced-apart sidewalls 26,28 extending generally perpendicularly from opposite sides of the base wall and an arcuate upper wall 30 interconnecting the sidewalls. The center of the base wall 24 includes a generally rectangular shaped cut-out portion 32.

The mounting post 20 is preferably hollow and tubular in shape and is attached to the center of the sleeve so that it extends generally perpendicularly down from the base wall 24 through the cut-out portion 32. The mounting post may be attached to the sleeve 18 in a conventional manner or integrally molded with the sleeve.

The end of the mounting post 20 that extends from the base wall 24 of the sleeve 18 includes a circumferentially extending and protruding rib 38. The interior surface of the mounting post 20 is threaded for coupling with the threaded end 34 of an elongated pole 36. The pole 36 may be formed of any suitable materials such as synthetic resin materials or wood and may be of any desired length.

The roller-engaging arm assemblies 14 are telescopically mounted in the sleeve 18. The arm assemblies are identical and each includes an elongated base section 40 and a generally perpendicularly extending arm section 42.

Figure 2:
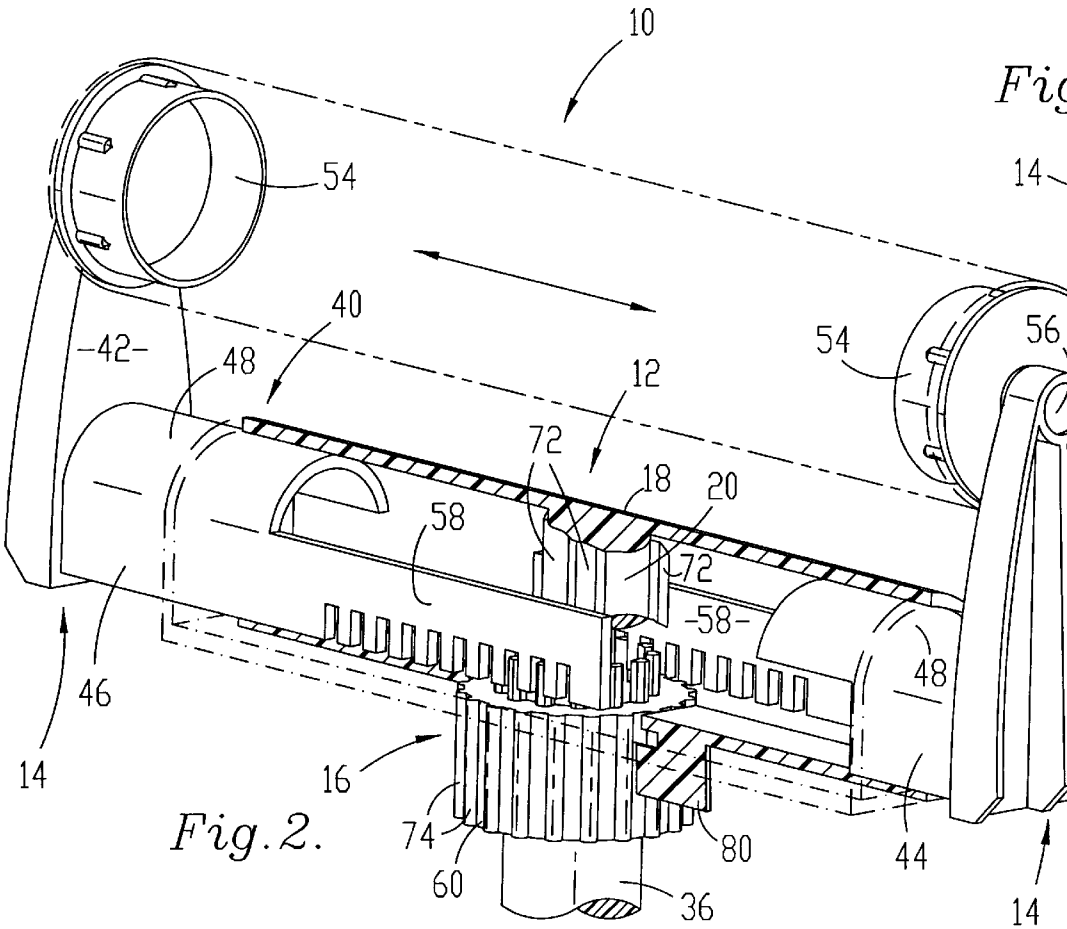
FIG. 2 is a perspective view of the roller holder with parts broken away to illustrate the rack and pinion-type adjusting means.

The base sections 40 are received within opposite open ends of the hollow sleeve 18 and are mounted for telescopic movement in and out of the sleeve along the longitudinal axis 22 of the sleeve. The base sections are each preferably generally U-shaped in cross section and include a pair of spaced-apart sidewalls 44,46 and an interconnecting arcuate upper wall 48. As best illustrated in FIG. 2, the base sections are sized to snugly fit within the hollow sleeve, but a sufficient tolerance exists between the base sections and the interior walls of the sleeve 18 to permit the base sections to be moved along the longitudinal axis of the sleeve.

The arm sections 42 are configured for supporting a roller therebetween and are generally wedge-shaped and extend perpendicularly from the outer ends of the base sections 40. As illustrated in FIG. 1, the narrow end of each arm section includes a mounting hole 52 that extends parallel to the longitudinal axis 22 of the sleeve 18.

The roller holder 10 is preferably provided with a pair of roller cover endcaps 54 that fit within the open ends of a roller to be held by the roller holder. The faces of the endcaps that extend from the roller each include an axially extending stub shaft 56. To mount the roller between the arm sections 42, the stub shafts 56 are inserted within the mounting holes 52 of the arm sections 42.

The adjusting mechanism 16 is preferably a rack and pinion-type gear mechanism that includes a pair of elongated rack-type gears 58 and a pinion-type adjustment knob 60 operably coupled with the rack-type gears 58. Each rack-type gear 58 is generally rectangular in shape and is attached to or integrally molded as a part of one sidewall 46 of its respective roller engaging arm assembly 14. As illustrated in FIG. 2, the gears extend inwardly into the hollow sleeve 18.

Returning to FIG. 1, the lower edge of each gear 58 includes a plurality of spaced-apart notches 62 formed therein that define a plurality of spaced-apart gear teeth 64. In preferred forms, each gear 58 includes nine gear teeth that are each 0.135" wide and spaced approximately 0.135" apart. The gear teeth of each gear 58 are bounded by a pair of tabs 66,68 that are wider than the gear teeth.

The rack-type gears 58 are configured to move along the sidewalls 26,28 of the sleeve when shifted by the adjustment knob 60. The sidewall 44 of each of the base sections of the arm assemblies includes a rectangular-shaped cutout portion 70 for receiving the end of the rack-type gear 58 attached to the opposite arm assembly 14 when the arm assemblies are positioned in their fully retracted position as described below.

To guide and support the rack-type gears 58 when they are moved relative to the sleeve 18 by the adjustment knob 60, the central body portion 12 also includes a pair of generally planar, rectangular-shaped arm guides 72 attached to each side of the periphery of the mounting post 20 adjacent the sidewalls 26,28 of the sleeve. As best illustrated in FIG. 3, the arm guides and the sidewalls of the sleeve define narrow guide channels therebetween for receiving the ends of the rack-type gears 58 and guiding the gears 58 when they are moved by the adjustment knob 60.

The adjustment knob 60 is generally ring-shaped and includes a plurality of equally spaced gear teeth 74 that extend from one of its faces and parallel to its axis. The knob preferably includes thirteen gear teeth that are approximately 0.3" long, 0.12" wide and spaced at least 0.135" apart.

The periphery of the knob 60 includes a plurality of equally spaced locking ribs 74 formed therein. In preferred forms, the knob includes 20 locking ribs spaced approximately 0.125" apart.

Figure 3:
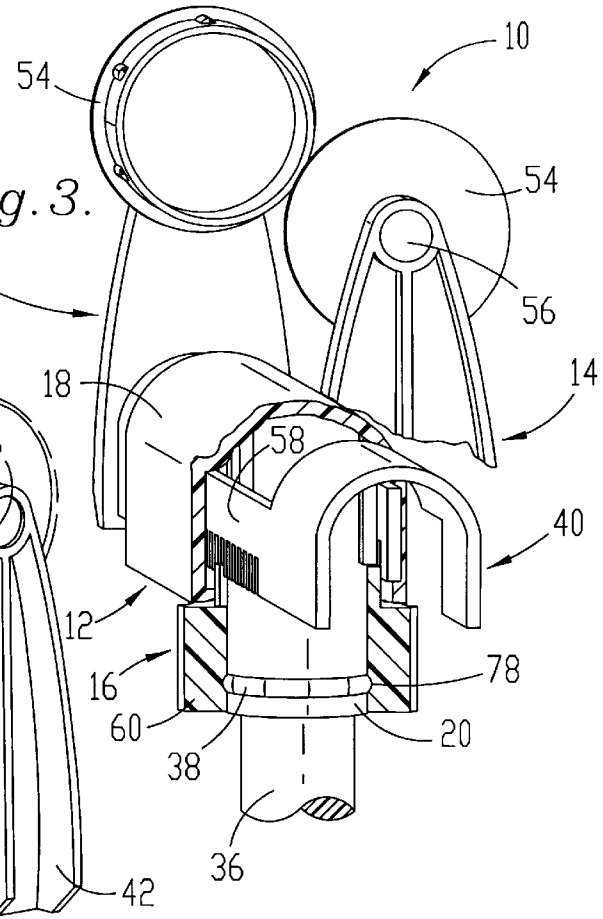
FIG. 3 is a perspective view of one end of the roller holder with parts broken away to clearly illustrate certain components of the adjusting means.

As best illustrated in FIG. 3, the interior wall of the knob includes a circular groove 78 that can be snap-fit over the mounting rib 38 on the mounting post 20 for rotatably mounting the adjustment knob to the mounting post. As best illustrated in FIG. 2, when the knob 60 is snap-fit over the mounting post 20, its gear teeth 74 extend upwardly through the cutout portion 32 on the base wall 24 of the hollow sleeve 18 and fit within and engage the gear teeth 64 formed in the rack-type gears 58.

In operation, the adjustment knob 60 can be rotated to laterally shift the rack-type gears 58 along the longitudinal axis 22 of the sleeve 18 and therefore telescopically move the base sections 40 of the arm assemblies 14 in and out of the open ends of the hollow sleeve 18. This adjusts the distance between the arm sections 42 of the arm assemblies 14 so that the roller holder may hold rollers of any length. The tabs 66,68 limit the travel of the rack-type gears 58 and prevent the arm assemblies from being shifted entirely out of the sleeve 18 as described in more detail below.

Specifically, when the adjustment knob 60 is rotated clockwise as viewed from FIG. 2, its gear teeth 74 engage the gear teeth 64 on the rack-type gears 58 and move the arm assemblies 14 outwardly to an extended position. The tabs 66 on the distal ends of the gears 58 prevent the knob from being rotated past a certain point, and thus define the fully extended position of the arm assemblies.

Conversely, when the adjustment knob 60 is rotated counterclockwise as viewed from FIG. 2, its gear teeth 74 move the arm assemblies 14 inwardly to a retracted position. The tabs 68 on the proximal ends of the gears 58 prevent the knob from being rotated past a certain point, and thus define the fully retracted position of the arm assemblies.

The roller holder 10 is preferably configured to support a standard 7" roller when its arm assemblies 14 are positioned in their fully retracted position and to support up to a 12" roller when its arm assemblies are positioned in their fully extended position. However, those skilled in the art will appreciate that the roller holder may be configured to support rollers of any length.

To lock the arm assemblies 14 in place once they have been shifted to their desired position, the roller holder 10 also includes a generally L-shaped detent 80 that extends perpendicularly down from the outside face of the base wall 24 of the sleeve 18. The detent fits between the locking ribs 74 on the adjustment knob 60 and "clicks" between the locking ribs when the knob is rotated. This permits the knob 60 to be rotated to any one of a multitude of discrete positions and impedes inadvertent rotation of the adjustment knob once it has been rotated to a desired position. This locks the arm assemblies 14 in position and prevents inadvertent detachment of the roller held by the arm assemblies.

The number of locking ribs 64 on the knob 60 and the spacing between the locking ribs determine the distance the arm assemblies 14 are moved relative to the sleeve 18 each time the knob 60 is clicked past the detent 80. Those skilled in the art will appreciate that the number of locking ribs and the spacing therebetween may be selected to provide any number of discrete positions of the arm assemblies 14.

Although the invention has been described with reference to the preferred embodiment illustrated in the attached drawing figures, it is noted that equivalents may be employed and substitutions made herein without departing from the scope of the invention as recited in the claims.

Having thus described the preferred embodiment of the invention, what is claimed as new and desired to be protected by Letters Patent includes the following:

1. An adjustable roller holder comprising:

a central body portion including an elongated hollow sleeve presenting a longitudinal axis and a mounting post attached to and extending generally perpendicularly from the sleeve;

an elongated pole for attachment to the mounting post;

a pair of spaced-apart roller-engaging arm assemblies configured for holding a roller therebetween, each of the arm assemblies including an elongated base portion telescopically received within the hollow sleeve for movement along the longitudinal axis of the sleeve and an upstanding arm section extending generally perpendicularly from one end of its respective base portion for engaging one end of the roller; and a rack and pinion gear mechanism operably coupled with the arm assemblies for selectively adjusting the distance between the upstanding arm sections of the arm assemblies for permitting the roller holder to hold rollers of different lengths.

2. The roller holder as set forth in claim 1, the rack and pinion gear mechanism including a pair of elongated rack-type gears each attached to a respective one of the arm assemblies, and a pinion-type adjustment knob rotatably mounted on the mounting post and operably coupled with the rack-type gears for telescopically moving the rack-type gears and the arm assemblies along the longitudinal axis of the sleeve when the knob is rotated for selectively adjusting the distance between the arm assemblies.

3. The roller holder as set forth in claim 1, one end of each of the arm sections including a mounting hole formed therein.

4. The roller holder as set forth in claim 1, further including a pair of roller cover end caps for receipt within the open ends of the roller, each of the end caps including a stub shaft that extends along the longitudinal axis of the roller when the end caps are inserted in the roller, the stub shafts each being adapted for receipt within the mounting hole of its respective arm section for mounting the roller between the arm sections of the arm assemblies.

5. The roller holder as set forth in claim 2, further including locking means operably coupled with the adjustment knob for preventing inadvertent rotation of the adjustment knob and thus locking the knob and the arm assemblies in place to prevent the roller from detaching from the arm assemblies.

6. An adjustable roller holder comprising:

a pair of spaced-apart roller-engaging arm assemblies configured for holding a roller therebetween; and a rack and pinion gear mechanism operably coupled with the arm assemblies for selectively adjusting the distance between the arm assemblies for permitting the roller holder to hold rollers of different lengths.

7. The roller holder as set forth in claim 1, the rack and pinion gear mechanism including a pair of elongated rack-type gears each attached to a respective one of the arm assemblies, and a rotatable, pinion-type adjustment knob operably coupled with the rack-type gears for moving the rack-type gears and the arm assemblies for selectively adjusting the distance between the arm assemblies when the knob is rotated.

8. The roller holder as set forth in claim 6, further including a central body portion having an elongated hollow sleeve presenting a longitudinal axis and a mounting post attached to and extending generally perpendicularly from the sleeve, the arm assemblies being telescopically received within the sleeve.

9. The roller holder as set forth in claim 7, further including an elongated pole for attachment to the mounting post.

10. The roller holder as set forth in claim 2, each of the arm assemblies including an elongated base portion telescopically received within the hollow sleeve for movement along the longitudinal axis of the sleeve, and an upstanding arm section extending generally perpendicularly from one end of its respective base portion for engaging one respective end of the roller.

11. The roller holder as set forth in claim 10, one end of each of the arm sections including a mounting hole formed therein.

12. The roller holder as set forth in claim 11, further including a pair of roller cover end caps for receipt within the open ends of the roller, each of the end caps including a stub shaft that extends along the longitudinal axis of the roller when the end caps are inserted in the roller, the stub shafts each being adapted for receipt within the mounting hole of its respective arm section for mounting the roller between the arm sections of the arm assemblies.

13. The roller holder as set forth in claim 7, further including locking means operably coupled with the adjustment knob for preventing inadvertent rotation of the adjustment knob and thus locking the knob and the arm assemblies in place to prevent the roller from detaching from the arm assemblies.

* * * * *